US008109618B2

(12) United States Patent
Zhou et al.

(10) Patent No.: US 8,109,618 B2
(45) Date of Patent: Feb. 7, 2012

(54) PIGMENT CARTRIDGE CARRIER DEVICE

(75) Inventors: Gui-Hong Zhou, Guang Dong Province (CN); Hai-Bo Shang, Hu Nan Province (CN)

(73) Assignees: Silitek Electronic (GZ) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 852 days.

(21) Appl. No.: 12/141,458

(22) Filed: Jun. 18, 2008

(65) Prior Publication Data

US 2009/0251515 A1 Oct. 8, 2009

(30) Foreign Application Priority Data

Apr. 4, 2008 (CN) ..... 2008 1 0027248

(51) Int. Cl.
*B41J 2/175* (2006.01)

(52) U.S. Cl. ..... 347/86; 347/84

(58) Field of Classification Search ..... None
See application file for complete search history.

(56) References Cited

U.S. PATENT DOCUMENTS

2007/0120901 A1* 5/2007 Sugiyama et al. ..... 347/85

FOREIGN PATENT DOCUMENTS

CN 200610163518.2 6/2007

* cited by examiner

*Primary Examiner* — Matthew Luu
*Assistant Examiner* — Erica Lin
(74) *Attorney, Agent, or Firm* — Rosenberg, Klein & Lee

(57) ABSTRACT

An ink cartridge carrier device includes a casing, having an opening and an inner chamber communicated with each other, for carrying an ink cartridge; a locking/unlocking mechanism, pivoted on the casing, such that the locking/unlocking mechanism is made to be rotatable and applies a restraining force to fix the ink cartridge into the inner chamber; a first elastic member, connected to the locking/unlocking mechanism, for providing the restraining force to actuate the locking/unlocking mechanism, so as to fix the ink cartridge into the inner chamber; a pushing mechanism, for pushing a part of the ink cartridge carried within the inner chamber out of the casing, so as to unload the ink cartridge. The device makes the ink cartridge well fixed, and enables the ink cartridge to be horizontally loaded or unloaded, which does not have the problems of unsmooth loading or unloading or getting stuck during unloading or loading.

10 Claims, 12 Drawing Sheets

PIGMENT CARTRIDGE CARRIER DEVICE

CROSS-REFERENCE TO RELATED APPLICATIONS

This non-provisional application claims priority under 35 U.S.C. §119(a) on Patent Application No(s). 200810027248.1 filed in China, P.R.C. on Apr. 4, 2008 the entire contents of which are hereby incorporated by reference.

BACKGROUND OF THE INVENTION

1. Field of the Invention

The present invention relates to an ink cartridge carrier device, and more particularly to an ink cartridge carrier device installed in printing equipment.

2. Related Art

Currently, there are many kinds of printing equipments, which adopt various corresponding pigment cartridges for printing texts and images, for example, an ink jet printer. As for the popular printer heads available on the market, an integral structure of the ink cartridge and the printer head is generally adopted, which is the so-called ink cartridge design, and the ink cartridge and a printing chip are integrated as a whole. Such an integral structure has many disadvantages.

1. When the pigment cartridge (i.e., the ink cartridge) needs to be replaced, the whole printer head (i.e., the ink cartridge and the printing chip) needs to be replaced completely. As a result, not only the cost is relatively high and the resource utilization is rather low, but also it does not satisfy the environmental protection demand.

2. Such integral structure usually occupies a larger space, such that it is inconvenient to replace the ink cartridge, which is time consuming and energy consuming.

Based on the above disadvantages, some researchers in this industry have developed an ink-head separated structure, that is, the ink cartridge and the printer head are separated from each other. Therefore, the ink cartridge can be replaced individually, without replacing the printer head, so as to save the cost and protect the environment. Accordingly, the loading of the ink cartridge has also been competitively researched in this industry. In China Patent No. 200610163518.2, an ink cartridge loading device is provided. FIG. 16 is a perspective view of an ink cartridge loading device. As shown in FIG. 16, the ink cartridge loading device includes a door 76, and a guiding member 77 is pivoted on a bottom edge of the door 76 corresponding to a bottom edge of an opening of the ink cartridge loading device. When the door 76 is opened or closed, the guiding member 77 pulls out an ink cartridge 63 or pushes it into the loading device. In order to install the ink cartridge 63 into the mechanism in a better way, a pressurizing member is disposed on the door 76, so as to provide an inward force for the ink cartridge 63. Furthermore, a press member is further disposed on the casing of the mechanism, which is helpful for pushing the ink cartridge. In addition, lock members 91 and 92 are disposed on the door 76, for closing the door at the opening of the casing, such that the pressurizing member tightly presses the ink cartridge 63, and makes the door 76 unlock and separate from the casing, so as to taken out the ink cartridge 63.

It should be noted that, due to the inverted hook-shaped guiding member 77 pivoted to the bottom edge of the door 76, when the door 76 is completely open, the position thereof is not straightly horizontal, and accordingly, when the ink cartridge 63 is pushed out for unloading, the angle formed between the ink cartridge 63 and the door 76 is not a right angle of 90 degrees. Thus, when it intends to pull the whole ink cartridge out of the casing, the ink cartridge may be stuck or the ink cartridge 63 may be unloaded extremely unsmoothly. Definitely, when the ink cartridge is loaded via the door 76 and the opening of the casing, similar problems may occur.

SUMMARY OF THE INVENTION

In view of the above problems, the present invention provides an ink cartridge carrier device, in which an ink cartridge is well fixed; when being unloaded or loaded, the ink cartridge is horizontally installed or pulled out of the casing, so as to avoid the problems that the loading or unloading process is rather unsmooth or the cartridge is stuck during loading or unloading.

The carrier device of the present invention includes: a casing, having an opening and an inner chamber communicated with each other, for carrying an ink cartridge; a locking/unlocking mechanism, pivoted on the casing, such that the locking/unlocking mechanism is made to be rotatable and used to selectively apply a restraining force to fix the ink cartridge within the inner chamber, and selectively release the restraining force to unload the ink cartridge; a first elastic member, one end of the first elastic member is connected to the locking/unlocking mechanism, for providing the restraining force to actuate the locking/unlocking mechanism, so as to fix the ink cartridge into the inner chamber; an pushing mechanism, for pushing a part of the ink cartridge carried within the inner chamber out of the casing when the locking/unlocking mechanism releases the restraining force, so as to unload the ink cartridge.

The other end of the first elastic member is connected to the casing or connected to the pushing mechanism.

The present invention is further directed to an ink cartridge carrier device, suitable for providing an inward and downward pressure for the ink cartridge, so as to ensure that the ink cartridge is well fixed.

In order to achieve the above objectives, the above technical solution has the following technical features.

The locking/unlocking mechanism has a locking portion selectively contacting with the ink cartridge carried within the inner chamber, in which the locking portion applies a restraining force to restrain the ink cartridge to move in the inner chamber.

The ink cartridge has a locked surface contacting with the locking portion, so as to fix the ink cartridge within the inner chamber.

The present invention is further directed to an ink cartridge carrier device, suitable for providing a locking function. Once the installation of the ink cartridge is finished, the carrier device applies an outward tension on the ink cartridge, so as to control the ink cartridge not to be pulled out.

In order to achieve the above objective, the above technical solution has the following technical features below.

The locked surface has a self-lock line, and once the locking portion is moved to a position of the self-lock line, the locking/unlocking mechanism is self-locked, and thus the ink cartridge carried in the inner chamber cannot be pulled out under an external force.

The present invention is still directed to an ink cartridge carrier device, suitable for pushing a part of the ink cartridge out of the casing when the ink cartridge is unloaded, so as to easily take out the ink cartridge, and to conveniently replace the ink cartridge.

In order to achieve the above objective, the above technical solution has the following technical features below.

The locking/unlocking mechanism has a locking portion, which selectively contacts with the ink cartridge carried within the inner chamber, so as to apply a restraining force to restrain the ink cartridge to move in the inner chamber.

The pushing mechanism is a sliding block, a guiding chute is opened on the casing, and the sliding block slides along the guiding chute.

The pushing mechanism is a second elastic member disposed on the casing or in the chamber.

The pushing mechanism is a flipping lever connected to the locking/unlocking mechanism.

The ink cartridge has a flipped portion, and the flipped portion is actuated by the flipping lever, so as to flip out a part of the ink cartridge.

In order to successfully load the ink cartridge into the inner chamber, the technical solution has the following technical features.

The ink cartridge has a guiding surface, slidingly contacting with the locking portion, which is convenient for the ink cartridge to be accommodated into the inner chamber.

Through the above technical solution in the present invention, the ink cartridge can be horizontally loaded or unloaded, which does not have problems of unsmoothly loading or unloading or getting stuck during loading or unloading. In addition, the ink cartridge carrier device provides an inward and downward pressure for the ink cartridge, so as to ensure that the ink cartridge is well fixed. Furthermore, the carrier device has a self-lock function, such that the ink cartridge cannot be pulled out of the inner chamber under an external force unless the locking/unlocking mechanism is rotated. When the ink cartridge is unloaded, the pushing mechanism pushes a part of the ink cartridge, so that the user can easily take out the ink cartridge through holding the pushed-out part with hands. The ink cartridge has a guiding surface, slidingly contacting with the locking portion, such that the ink cartridge can be successfully loaded smoothly, which is convenient for loading, unloading, and replacing the ink cartridge.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

Figure 1:
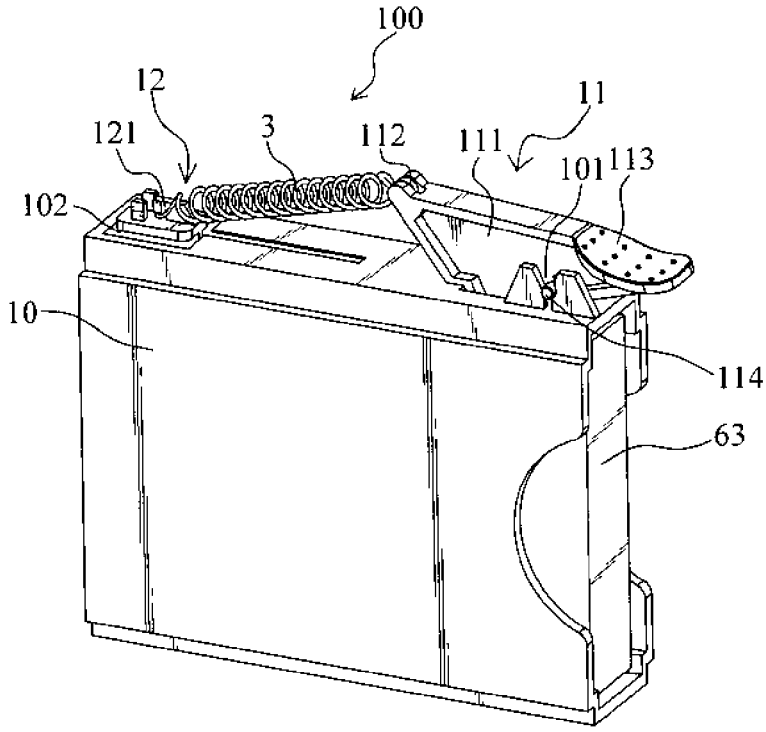
FIG. 1 is a perspective view of a first embodiment of the present invention.

First, it should be firstly mentioned that, in a common ink jet printer has four colors that includes black, cyan, magenta, and yellow. In the embodiments of the present invention, four ink cartridge respectively filled with inks of the four colors are exemplified for illustration. The four ink cartridges have the same structure, so the configuration and actuation situation of merely one ink cartridge is described below. The action structures of the ink cartridges are all the same, which will not be described repeatedly.

FIGS. 1 to 4 show a first embodiment of the present invention. First, referring to FIGS. 1 and 2, an ink cartridge carrier device 100 is provided in the first embodiment, which includes: a casing 10 for carrying an ink cartridge 63, an pushing mechanism 12, a locking/unlocking mechanism 11, and a first elastic member 3 respectively connected between the pushing mechanism 12 and the locking/unlocking mechanism 11, in which the first elastic member is a spiral spring.

The ink cartridge carrier device installed in the ink jet printer of the present invention, the ink cartridge 63 has a guiding surface slidingly contacting with the locking portion, such that the ink cartridge 63 may be smoothly loaded. In addition, as shown in FIG. 3C, the ink cartridge carrier device 100 provides an inward and downward pressure for the ink cartridge 63, so as to ensure that the ink cartridge is well fixed. Furthermore, the carrier device has a self-lock function, such that the ink cartridge cannot be pulled out of the inner chamber under an external force unless the locking/unlocking mechanism 11 is rotated.

Figure 4:
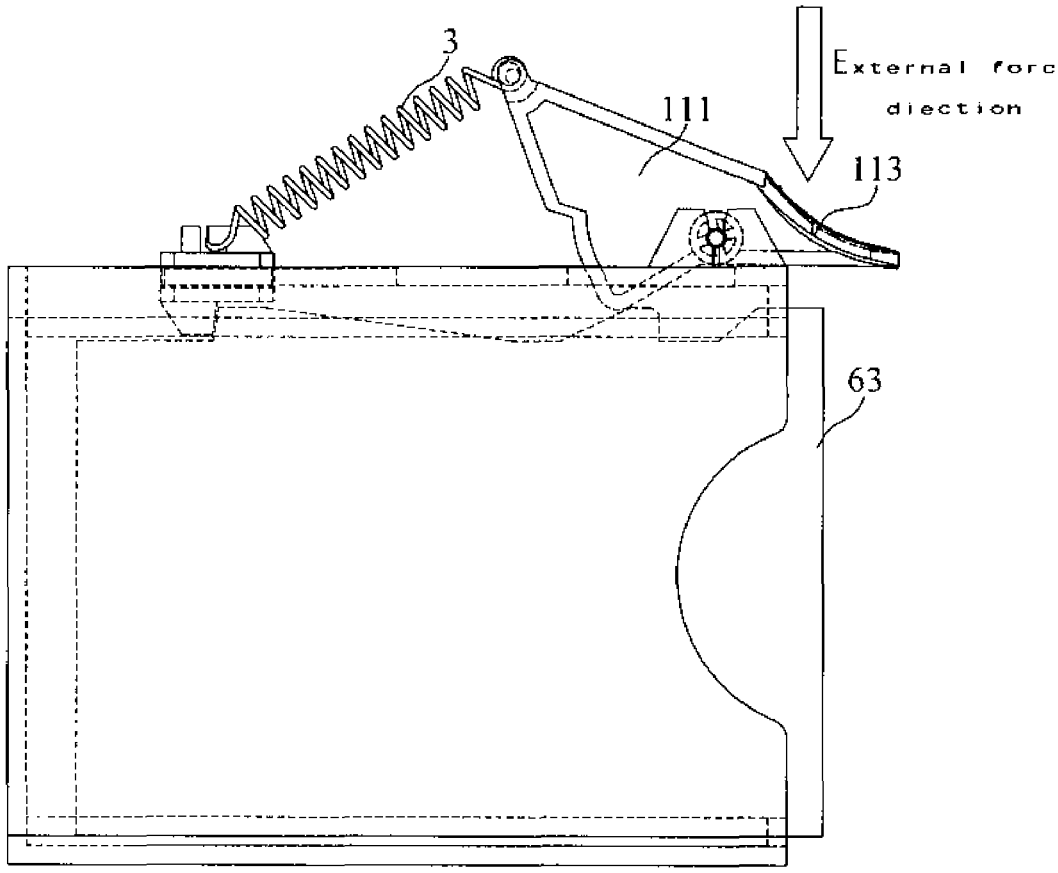
FIG. 4 is a schematic view when a part of the ink cartridge is pushed according to the first embodiment.
Figure 5:
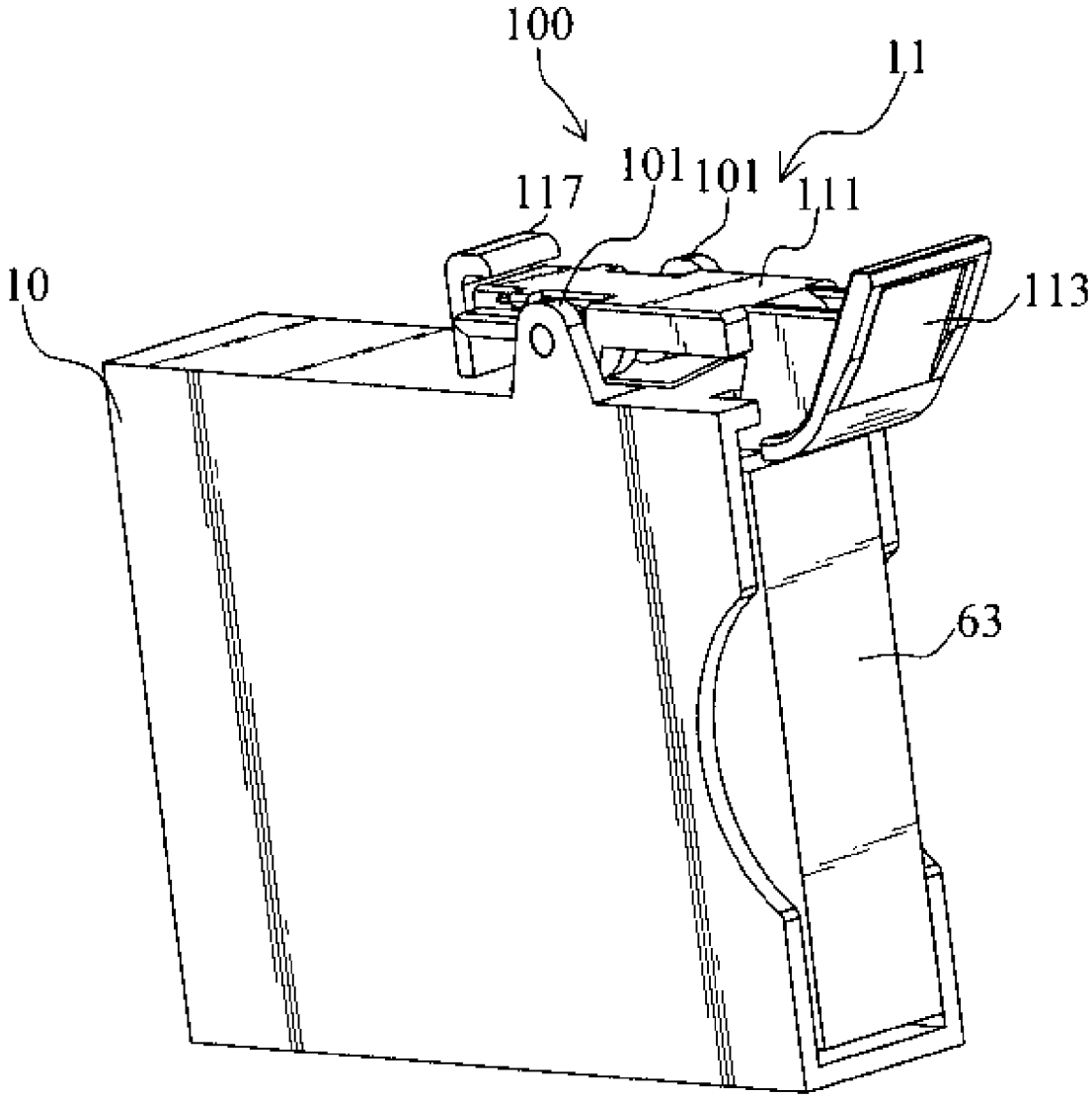
FIG. 5 is a perspective view of a second embodiment of the present invention, in which an ink cartridge is completely loaded.
Figure 6:
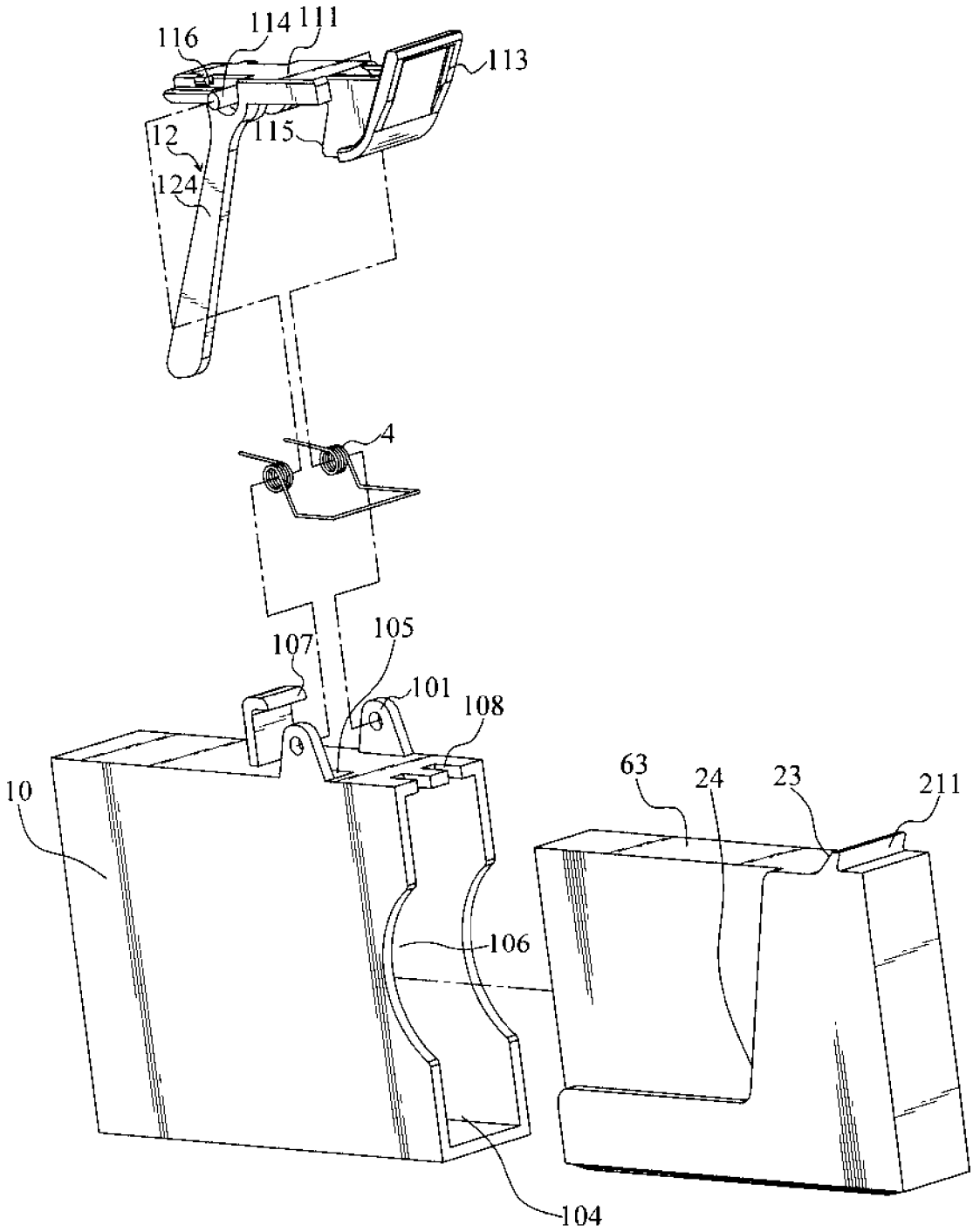
FIG. 6 is an exploded view of the second embodiment.

When the ink cartridge 63 is unloaded, both the first elastic member 3 and the pushing mechanism 12 are driven by pressing the locking/unlocking mechanism 11, so as to release the pressure on the ink cartridge 63 (as shown in FIG. 4), thereby unloading the ink cartridge 63. In this manner, during an unloading process, the ink cartridge 63 is horizontally unloaded, so as to avoid the problems of unsmooth unloading or getting stuck during unloading. When the ink cartridge 63 is unloaded, the pushing mechanism pushes a part of the ink cartridge 63, and the user holds the pushed part with hands, so as to take out the ink cartridge 63. Thus, it is convenient to load and unload the ink cartridge 63.

Therefore, the present invention does not have designs of the door 76 and the guiding mean 77 at the bottom of the door 76 as in the prior art. Accordingly, the phenomenon that the door 76 at the open position is not horizontal in the prior art does not occur any more in the present invention, and the problems of unsmooth loading or getting stuck during loading do not occur as well, when the ink cartridge 63 is loaded.

It should be noted that, the replacement of the ink cartridge is a combination of unloading and loading the ink cartridge 63. Therefore, the detailed structures of the above elements and the associated actuation motions for realizing the unloading or loading of the ink cartridge 63 are further described below in detail.

The casing 10 has an opening 104 and an inner chamber 106 communicated with the opening 104, in which the inner chamber 106 is used to accommodate the ink cartridge 63. A rotation retainer 101 is protruded and a through hole 105 is opened at a front part of the casing 10, and an installation hole 102 and a guiding chute 103 communicated with the installation hole 102 are opened at a back part of the casing.

Figure 2:
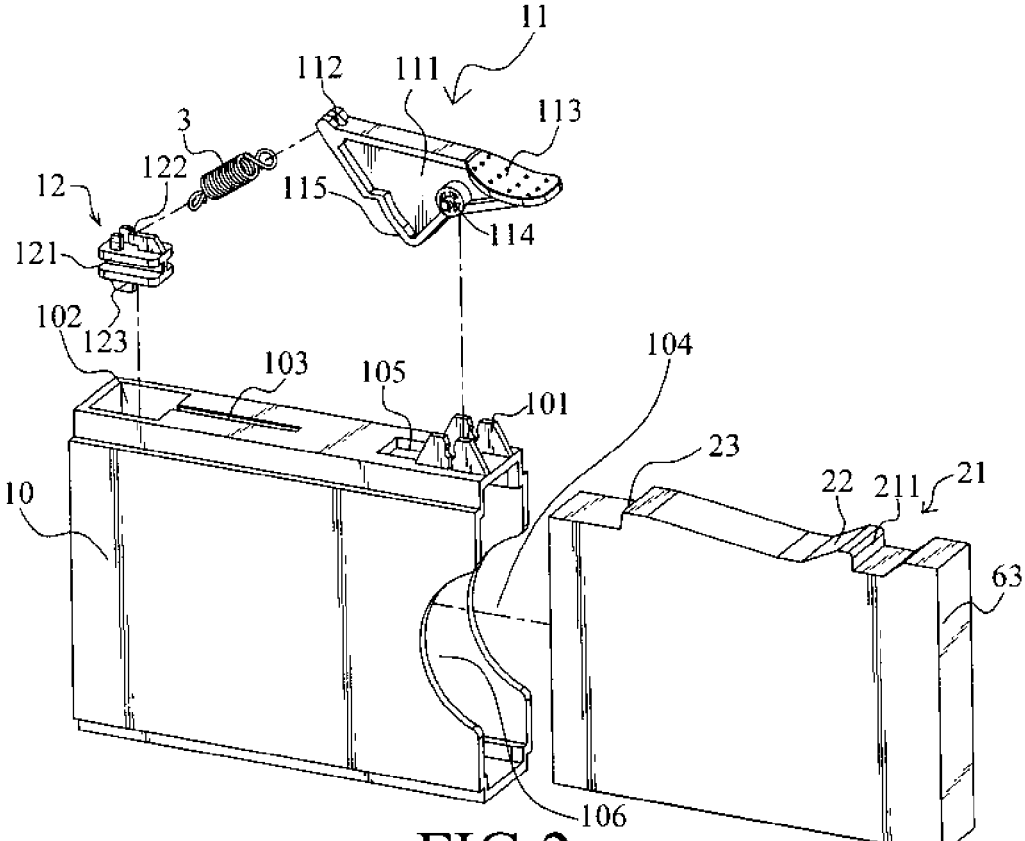
FIG. 2 is an exploded view of the first embodiment.

The locking/unlocking mechanism 11 has a main body 111 and a revolving shaft 114. The locking/unlocking mechanism 11 is rotatably installed in the rotation retainer 10 of the casing 10 through the revolving shaft 114. As shown in FIG. 2, the main body 111 has a locking portion 115 at a lower part thereof, and the locking portion 115 is designed into a V-shaped configuration and passes through and extends into the through hole 105. The main body 111 further has a connecting end 112 and a manual operation portion 113. The connecting end 112 is connected to one end of a first elastic member 3, and the other end of the elastic member is connected to the pushing mechanism 12. Once being tightly stretched, the first elastic member 3 provides a restraining force for the locking portion 115, such that the locking portion 115 tightly locks the ink cartridge 63, thereby fixing the ink cartridge 63 in the casing 10 (which is described below).

The pushing mechanism 12 has a sliding block 121, a connecting portion 122, and a pushing portion 123 under the sliding block 121. As shown in FIG. 2, the sliding block 121 is installed in the installation hole 102, and the connecting portion 122 is connected to the first elastic member 3. Under the elastic force of the first elastic member 3, the sliding block 121 is forced to move in the guiding chute 103 connected to the installation hole 102, and the pushing portion 123 under the sliding block 121 may contact with the ink cartridge 63, so as to push the ink cartridge 63 out of the inner chamber 106.

The ink cartridge 63 further has a locked portion 21, and the locked portion 21 has a locked surface 211. The ink cartridge 63 further has a guiding surface 22 and a pushed surface 23 at the back end thereof. The pushing portion 123 may contact with the pushed surface 23, so as to push the ink cartridge 63 out of the inner chamber 106.

Figure 3A:
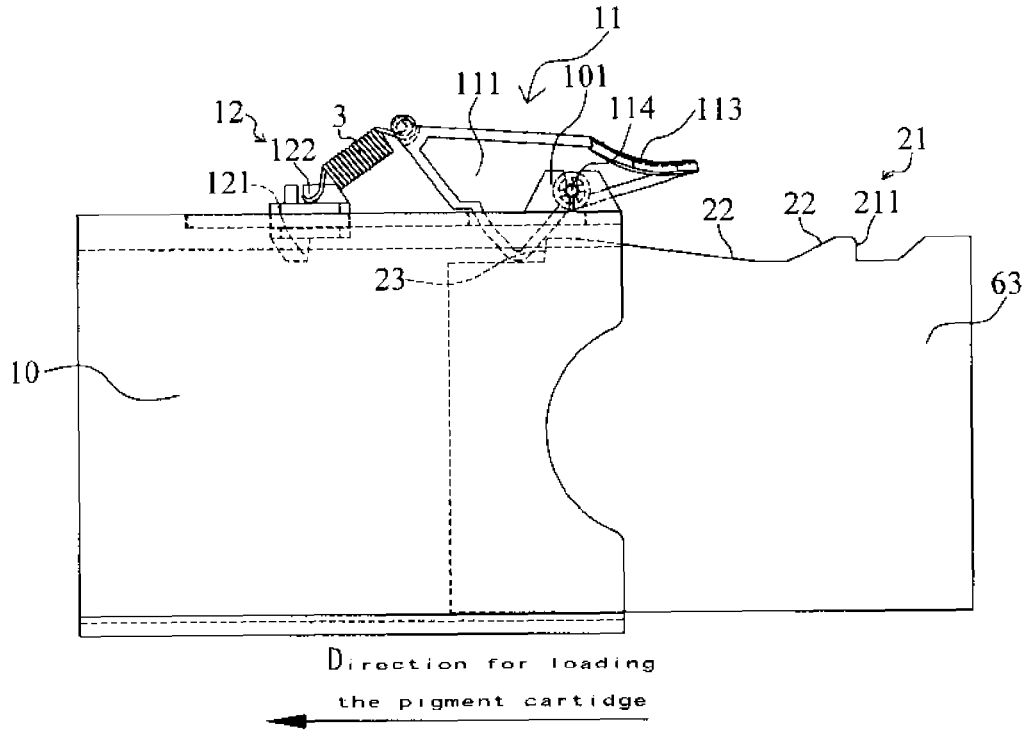
FIG. 3A is a schematic view when an ink cartridge is being loaded according to the first embodiment.

Please refer to FIG. 3A, when the ink cartridge 63 is loaded, the user inserts the ink cartridge 63 into the inner chamber 106 via the opening 104, the locking portion 115 extending into the inner chamber 106 first contacts with the pushed surface 23 of the ink cartridge 63, such that the locking portion is pushed to rotate, and finally the ink cartridge 63 overcomes and passes through the locking portion 115. During the whole process, the connecting portion 122 of the locking mechanism 11 is rotated to a higher position, so as to pull the elastic member 3. Accordingly, the pushing portion 123 under the sliding block 121 connected to the elastic member 3 contacts with the pushed surface 23. Subsequently, the locking portion 115 moves along the guiding surface 22. At this time, if the user continues to push the ink cartridge 63, the locking portion 115 enters into a depressed locking area. Such locking area has a locked surface 211, and a beveled edge of the locking portion 115 contacts with the locked surface 211. At this time, the ink cartridge 63 is locked in the inner chamber 106.

Figure 3B:
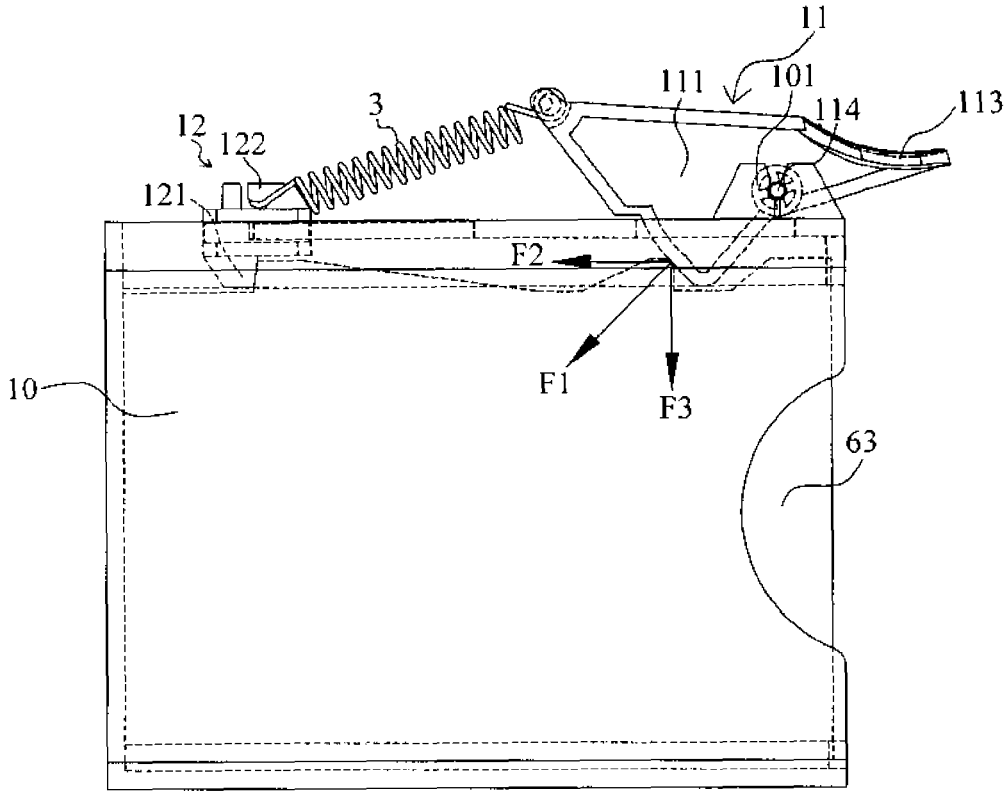
FIG. 3B is a schematic view when the ink cartridge is completely loaded.
Figure 3C:
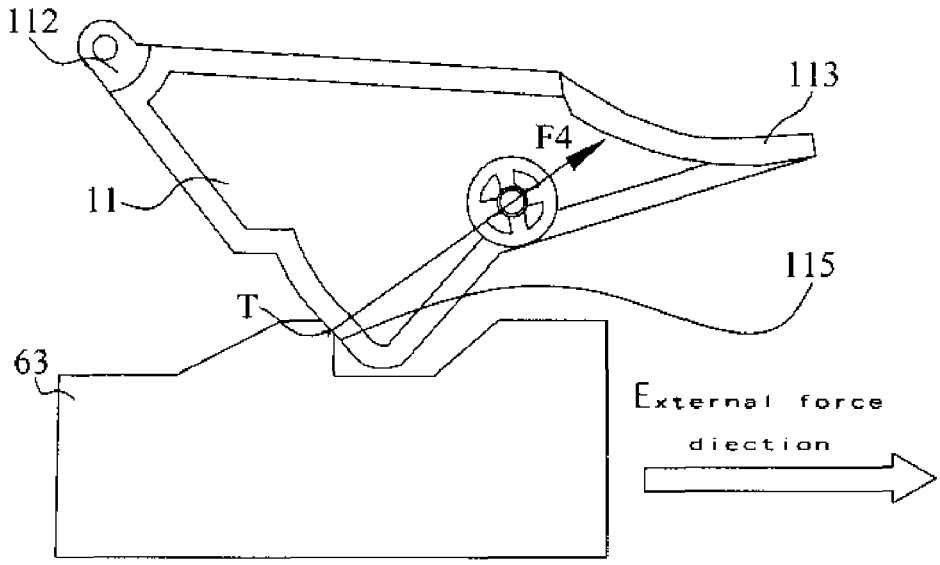
FIG. 3C is a schematic view of a self-lock according to the first embodiment.

Referring to FIG. 3B, the ink cartridge 63 is locked by the locking portion 115, in which the beveled edge of the locking portion 115 applies an oblique force F1 to the ink cartridge, and the oblique force F1 is further divided into a component force F2 towards a backward horizontal direction along the inner chamber and a component force F3 along a gravity direction. In this manner, the two component forces F2 and F3 ensure that the ink cartridge 63 is stably fixed in the inner chamber 106.

Please refer to FIG. 3C, the casing 10 and all the structures there-above are omitted. In FIG. 3, only a part of the ink cartridge 63 is depicted, which is fixed in the inner chamber 106. When an external force is applied to pull the ink cartridge 63 along the direction shown in the drawing, the locking portion 115 is rotated to a position T, and corresponding to the T position, the ink cartridge is located at the self-lock line on the locked surface 211. At this time, the counteraction force F4 of the ink cartridge 63 to the locking portion 115 passes through a center of the revolving shaft 114, such that the moment of the external force on the locking portion 115 is zero, so as to ensure that the ink cartridge 63 cannot be pulled out under an external force unless the locking/unlocking mechanism 11 is pressed.

Referring to FIG. 4, the user may apply an external force as indicated by the arrow in FIG. 4 to press the manual operation portion 113. Upon being pressed, the manual operation portion 113 rotates to a low position, and if the manual operation portion 113 is continuously pressed, the locking portion 115 is released from being contacted with the locked surface 211. During the above process, the connecting end 112 rotates to the higher position, the elastic member 3 is tightly stretched, the sliding block 121 connected to the elastic member 3 slides forward along the guiding chute 103, and the pushing portion 123 touches the pushed surface 23 of the ink cartridge 63 and pushes a part of the ink cartridge 63 out of the casing 10, and the pushed-out part may be pulled out by the user with hands. It is convenient for the user to unload or replace the ink cartridge.

FIGS. 5 to 8 show a second embodiment of the present invention. Please refer to FIGS. 5 and 6, the ink cartridge carrier device 100 includes a casing 10, and the casing 10 has an opening 104 and an inner chamber 106 communicated with the opening 104. The inner chamber is used to accommodate the ink cartridge 63. A rotation retainer 101 is protruded and a through hole 105 is opened on the front end of the casing 10. A notch 108 is opened on the front end thereof.

The ink cartridge carrier device 100 further has a locking/unlocking mechanism 11, and the locking/unlocking mechanism 11 has a main body 111 with a revolving shaft 114. The locking/unlocking mechanism 11 is rotatably installed in the rotation retainer 101 on the casing 10 through the revolving shaft 114. The main body 11 has a locking portion 115 disposed at a lower part thereof, and the locking portion 115 passes through and extends into the through hole 105. The main body 111 further has a manual operation portion 113 and a snapping portion 116. A first torsion spring 4 is fitted on the revolving shaft 114, in which one end of the torsion spring 4 is snapped in the snapping portion 116, and the other end thereof bears against the casing 10.

The ink cartridge carrier device 100 further has a pushing mechanism 12, which is a flipping lever 124 connected to the main body 111. Preferably, the flipping lever 124 and the main body 111 are integrally formed.

The ink cartridge 63 has a locked portion 21, and the locked portion 21 has a locked surface 211. The ink cartridge 63 further has a guiding surface 22 and a flipped surface 24 on a side surface thereof. The pushing portion 123 may be contacted with the flipped surface 24, so as to push the ink cartridge 63 out of the inner chamber 106.

Figure 7A:
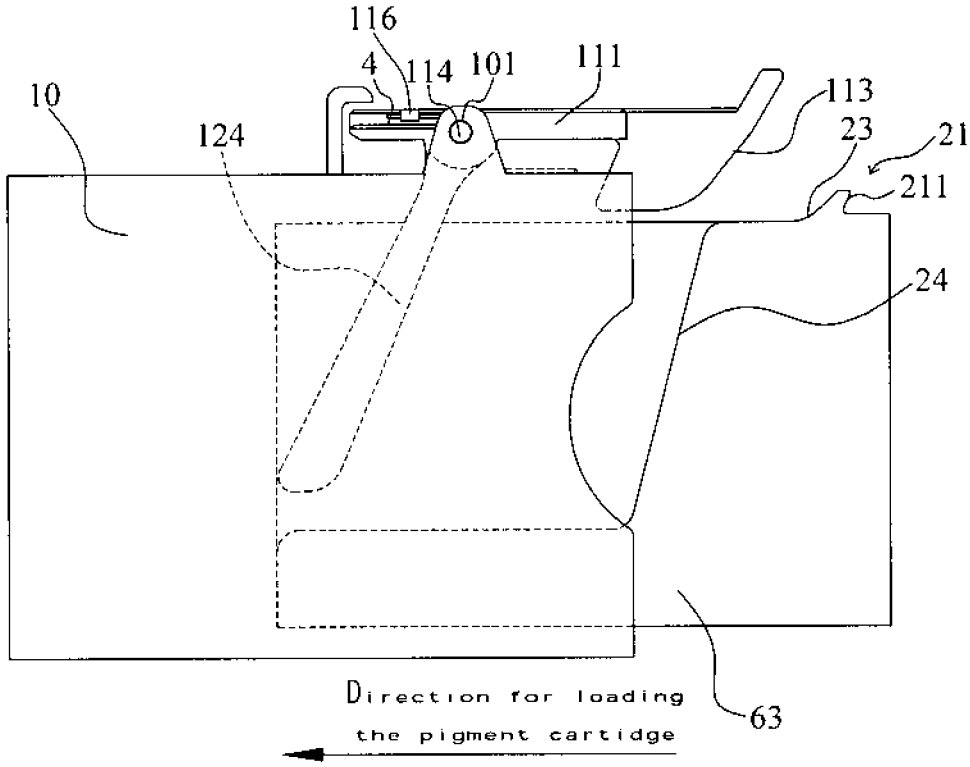
FIG. 7A is a schematic view when the ink cartridge is being loaded according to the second embodiment.
Figure 7B:
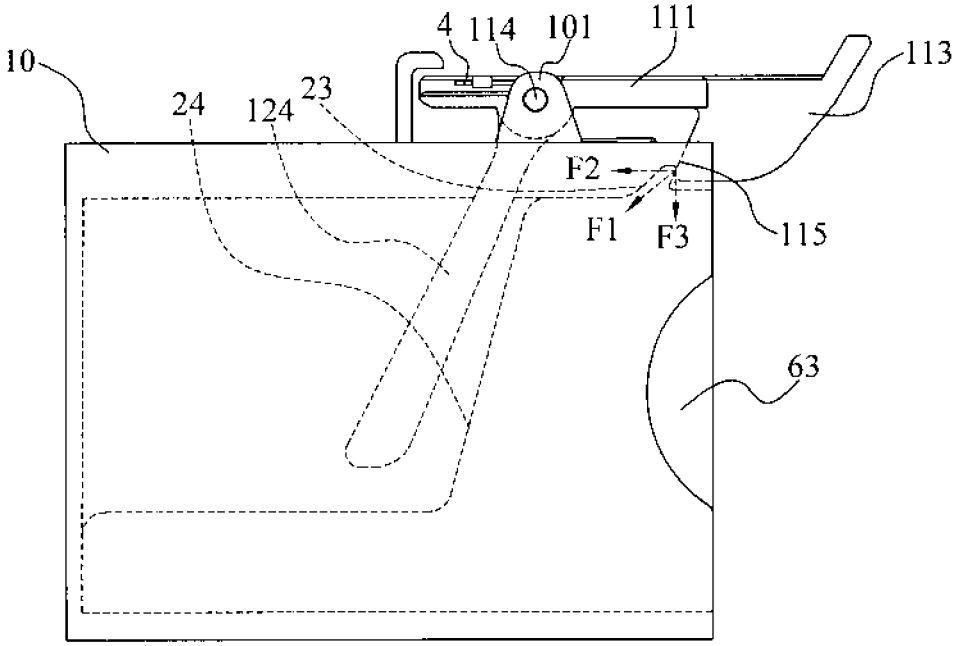
FIG. 7B is a schematic view when the ink cartridge is completely loaded.

Referring to FIGS. 7A and 7B, when the ink cartridge 63 is loaded, the user inserts the ink cartridge 63 into the inner chamber 106 via the opening 104. The manual operation portion 113 and the locking portion 115 both move along the guiding surface 22, and the locking portion 115 is also raised. Once the locking portion 115 is released from contacting with the guiding surface 22, the locking portion is lowered down to the locking area position and contacts with the locked surface 211. At this time, the torsion spring 4 applies a restraining force to the main body 111 on one end of the snapping portion 116, such that the locking portion 115 on the other end of the revolving shaft locks the ink cartridge 63 (which is described below). At this time, the ink cartridge 63 is locked in the inner chamber 106 by the locking portion 115.

Please refer to FIG. 7B, the ink cartridge 63 is locked by the locking portion 115. The locking portion 115 applies an oblique force F1 to the ink cartridge 63, and the oblique force F1 is divided into a component force F2 towards a backward horizontal direction along the inner chamber and a component force F3 along a gravity direction. The two component forces F2 and F3 ensure that the ink cartridge 63 is stably fixed in the inner chamber 106.

Figure 7C:
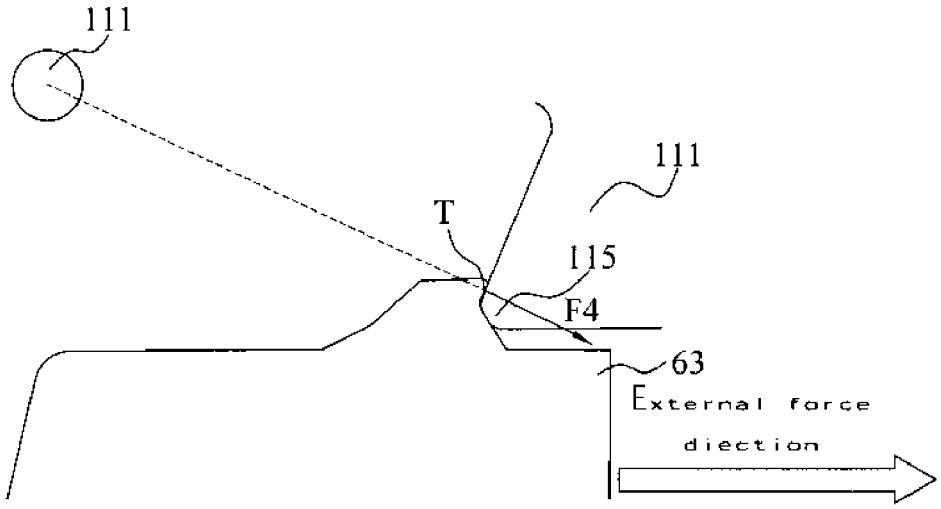
FIG. 7C is a schematic view of a self-lock according to the second embodiment.

FIG. 7C is a perspective view of the ink cartridge carrier device. Referring to FIG. 7C, merely the locking portion 115, the revolving shaft 114 of the main body 111, and the ink cartridge are shown, and the casing 10 and all the structures there-above are omitted, so as to clearly show the force between the ink cartridge 63 and the locking portion 115. When an external force is applied to pull the ink cartridge 63 along the direction indicated by the arrow as shown in the drawing, the locking portion 115 is rotated to a position T, and corresponding to the T position, the ink cartridge is located at the self-lock line on the locked surface 211. At this time, the counteracting force F4 of the ink cartridge 63 to the locking portion 115 passes through the center of the revolving shaft 114, such that the moment of the external force on the locking portion 115 is zero, so as to ensure that the ink cartridge 63 cannot be pulled out under an external force unless the locking/unlocking mechanism 11 is pressed.

Figure 8:
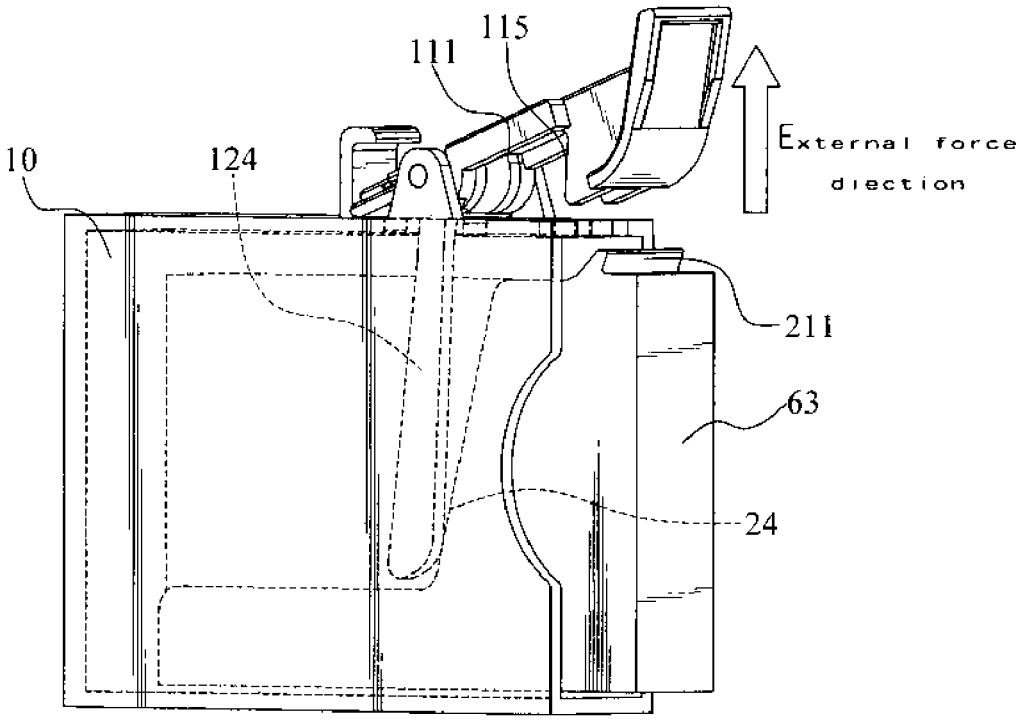
FIG. 8 is a schematic view when a part of the ink cartridge is pushed according to the second embodiment.

Referring to FIG. 8, the manual operation portion 113 is flipped along the external force direction as indicated by the arrow in the drawing. The manual operation portion 113 is rotated to a higher position, and if it is continuously flipped, the locking portion 115 is released from the contacting state with the locked surface 211. During the whole process, the flipping lever 124 connected to the main body touches the flipped surface 24 of the ink cartridge 63, and pushes a part of the ink cartridge 63 out of the casing 10. In this manner, the user may pull out the whole ink cartridge 63 by holding the pushed-out part with hands, so it is convenient for the user to unload or replace the ink cartridge 63.

Figure 9:
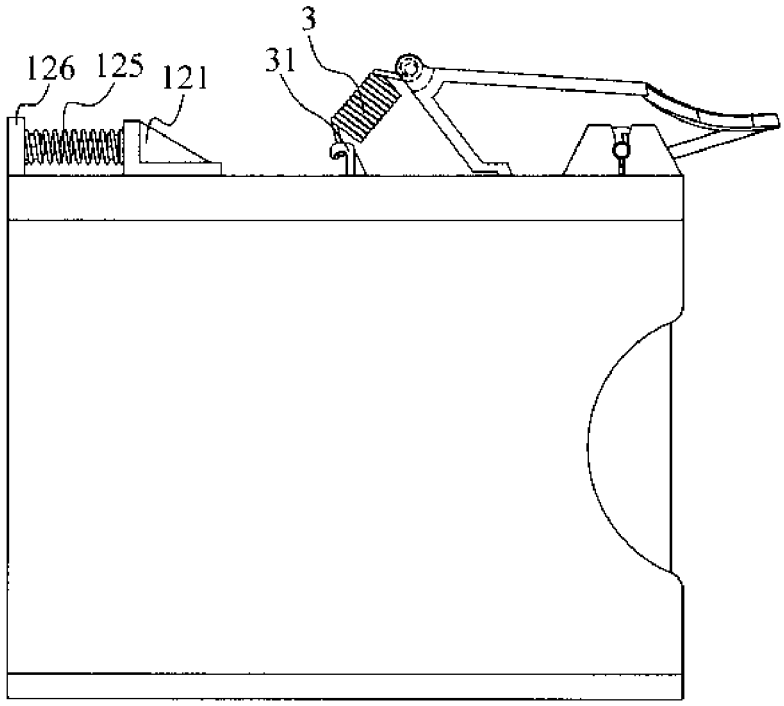
FIG. 9 is a schematic view of a third embodiment of the present invention.

FIG. 9 shows a third embodiment of the present invention. The difference between this embodiment and the first embodiment is that one end of the first elastic member 3 is connected to a fixing hook 31 protruding from the casing 10. A baffle plate 126 and a first compressive elastic member 125 are protruded on the back end of the casing 10, and the first compressive elastic member 125 is connected between the baffle plate 126 and the sliding block 121. According to the descriptions on the unloading or replacing of the ink cartridge in this embodiment, when the manual operation portion 113 is actuated, the first compressive elastic member 125 pushes the sliding block 121 to slide along the guiding chute 103, and pushes a part of the ink cartridge 63 out of the casing 10, such that it is convenient to unload or replace the ink cartridge 63. Preferably, the first compressive elastic member 125 is also a compression spring.

Definitely, it may also replace the locking/unlocking mechanism 11 by the locking/unlocking mechanism in the second embodiment, and the pressing motion is changed into an upward flipping motion for unloading the ink cartridge. At the same time, the structure of the ink cartridge 63 must be changed correspondingly, and the ink cartridge 63 still maintains a pushed surface 23 or a similar structure. The detailed contents can be obtained with reference to FIGS. 5 to 8.

Figure 10:
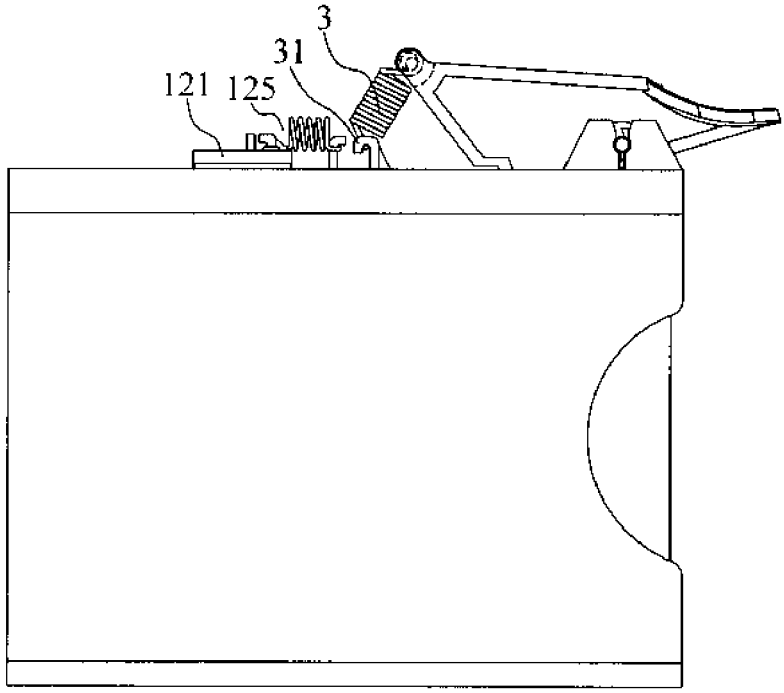
FIG. 10 is a perspective view of a fourth embodiment of the present invention.

FIG. 10 shows a fourth embodiment of the present invention. The difference between this embodiment and the third embodiment is that the first compressive elastic member 125 is directly connected between the fixing hook 31 protruding from the casing 10 and the sliding block 121. The operating principle in this embodiment can be obtained with reference to the descriptions in the first embodiment and the third embodiment.

Definitely, similar modifications or alternations as described above can also be made in this embodiment which will not be described herein.

Figure 11:
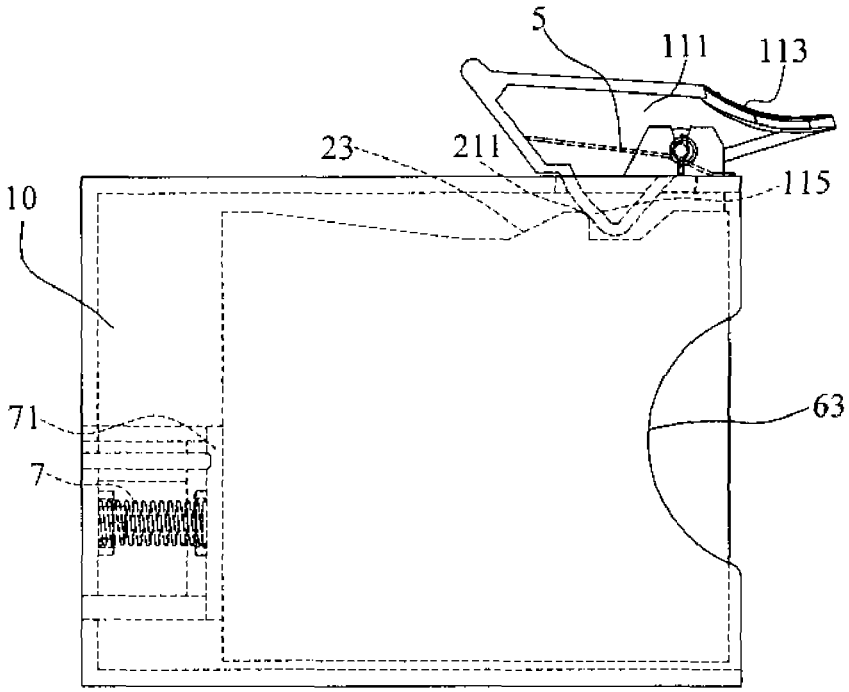
FIG. 11 is a perspective view of a fifth embodiment of the present invention.

FIG. 11 shows a fifth embodiment of the present invention. The difference between this embodiment and the first embodiment is that the pushing mechanism is changed from a sliding block into a push-out elastic member. Due to the push-out elastic member 7, it is not necessary to open the installation hole 102 and the guiding chute 103 on the casing 10 any more. One end of the push-out elastic member 7 is connected to an inner wall of the casing 10 (which is the prior art, and will not be described in detail). Thus, once the locking portion 115 is released from the contacting state with the locked surface 211, the push-out elastic member 7 pushes a part of the ink cartridge 63 out of the casing 10. In addition, the first elastic member 3 is replaced by a second torsion spring 5. The second torsion spring 5 is fitted on the revolving shaft 114, in which one end of the second torsion spring 5 is snapped on the main body 111, and the other end is snapped on the casing 10. The function of the second torsion spring 5 is equivalent to that of the first elastic member in the first embodiment.

Definitely, in order to make the push-out elastic member be more stably extended and compressed, a pushing element 71 is further disposed on one end of the push-out elastic member 7 attached to the ink cartridge 63, and the pushing element 71 directly contacts with the ink cartridge 63. The operating principles for loading, unloading, or replacing the ink cartridge can be obtained with reference to the descriptions of the first and third embodiments.

Figure 12:
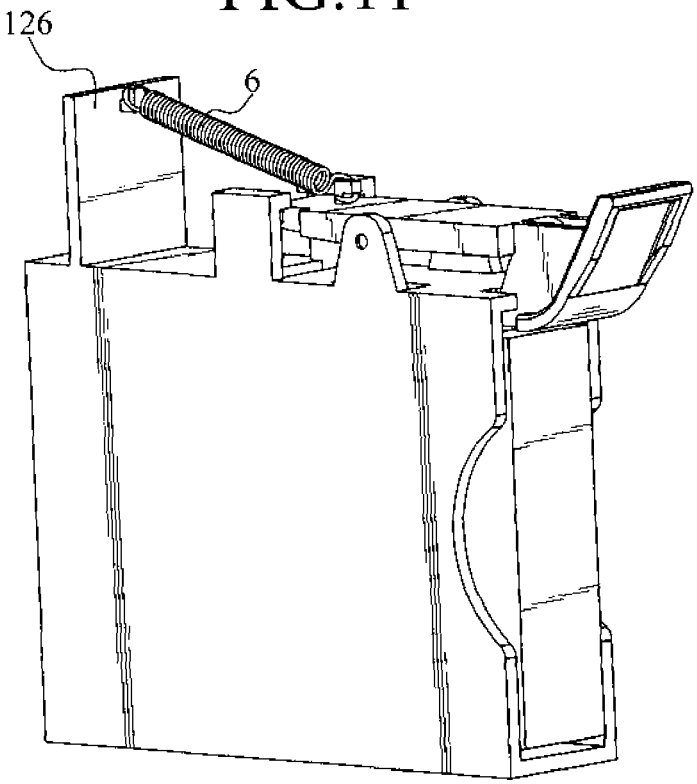
FIG. 12 is a perspective view of a sixth embodiment of the present invention.

FIG. 12 shows a sixth embodiment of the present invention. The difference between this embodiment and the second embodiment is that the first torsion spring 4 is replaced by a second tension spring 6. The baffle plate 126 is disposed on the back end of the casing 10, one end of the second tension spring 6 is connected to the main body 111, and the other end is connected to the baffle plate 126.

Figure 13:
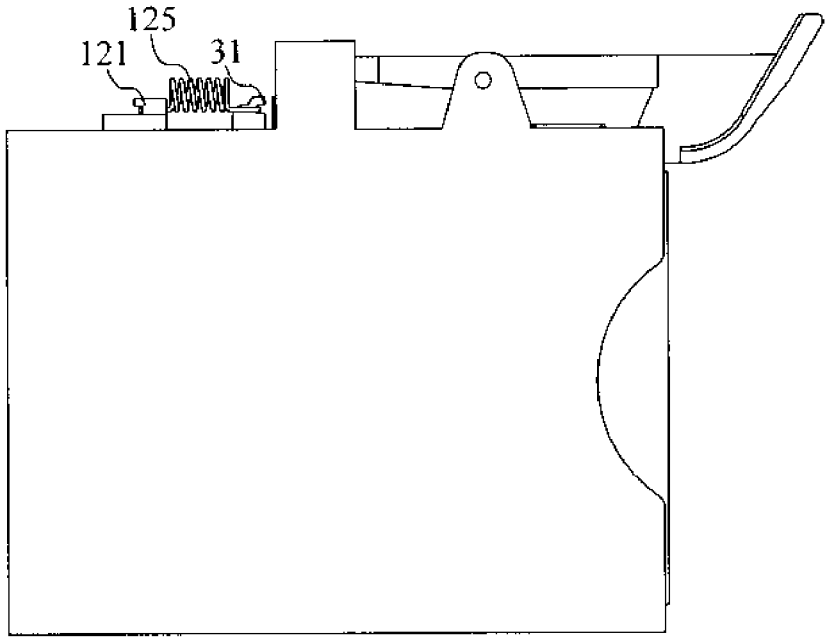
FIG. 13 is a perspective view of a seventh embodiment of the present invention.

FIG. 13 shows a seventh embodiment of the present invention. The difference between this embodiment and the third embodiment is that the pushing mechanism 12 is changed from the flipping lever 124 into the sliding block 121, and has the compressive elastic member 125. One end of the first compressive elastic member 125 is connected to the sliding block 121, and the other end is connected to the fixing hook 31 protruding from the casing 10. Similar to the first embodiment, the installation hole 102 for installing the sliding block 121 and the guiding chute 103 communicated with the installation hole 102 are opened on the casing 10. The details can be obtained with reference to the relevant descriptions in the first embodiment. The pushing mechanism of this embodiment is still the same as that of the second embodiment.

Figure 14:
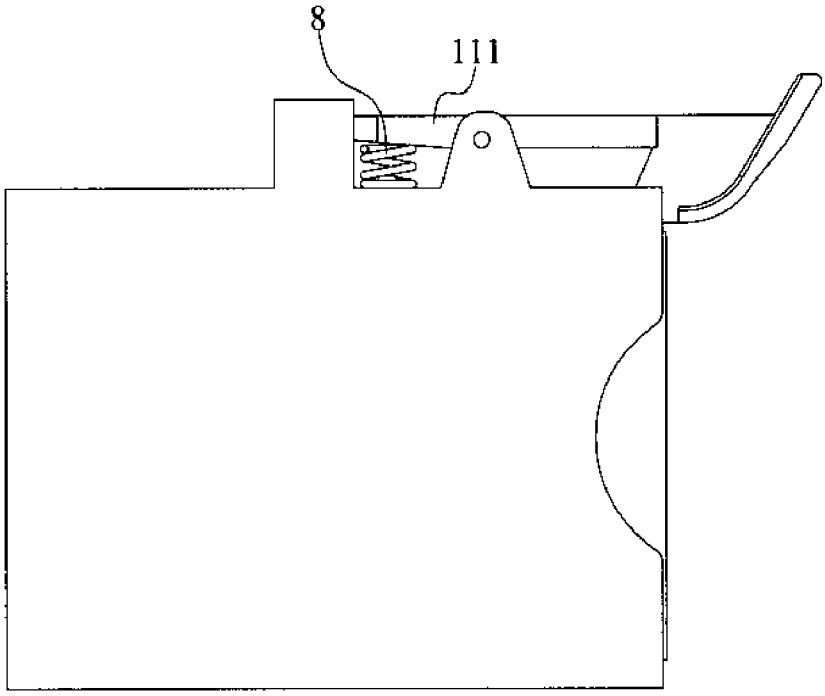
FIG. 14 is a perspective view of an eighth embodiment of the present invention.

FIG. 14 shows an eighth embodiment of the present invention. The difference between this embodiment and the second embodiment is that the first torsion spring 4 is replaced by a second compressive elastic member 8 disposed between the casing 10 and the main body 111. It should be noted that, the second compressive elastic member 8 should be disposed on the back end position of the main body, so as to ensure that the locking portion 115 applies a restraining force to the locked surface 211 of the ink cartridge, thereby locking the ink cartridge 63. Preferably, the second compressive elastic member 8 is a compression spring.

It should be noted that, the pushing mechanism 12 in this embodiment may be the flipping lever in the second embodiment, and the detailed technical content thereof can be obtained with reference to the descriptions in the second embodiment and accompanying drawings. The pushing mechanism 12 in this embodiment may also be an elastic member, and the detailed technical content thereof can be obtained with reference to the descriptions in the fourth embodiment and accompanying drawings. Definitely, the structures of the ink cartridge and the casing may also be altered correspondingly, and the details can be obtained with reference to the relevant descriptions in the corresponding embodiments and the accompanying drawings.

Figure 15:
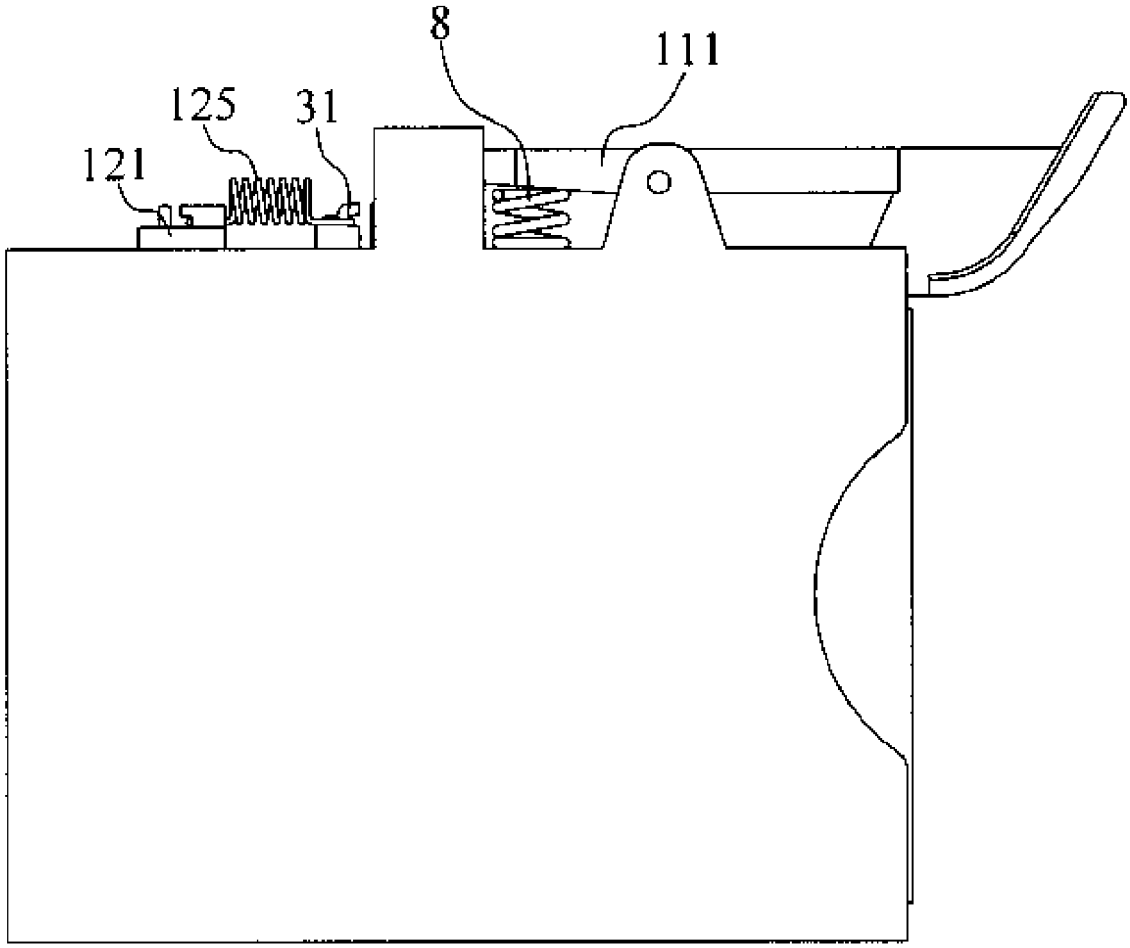
FIG. 15 is a perspective view of a ninth embodiment of the present invention.
Figure 16:
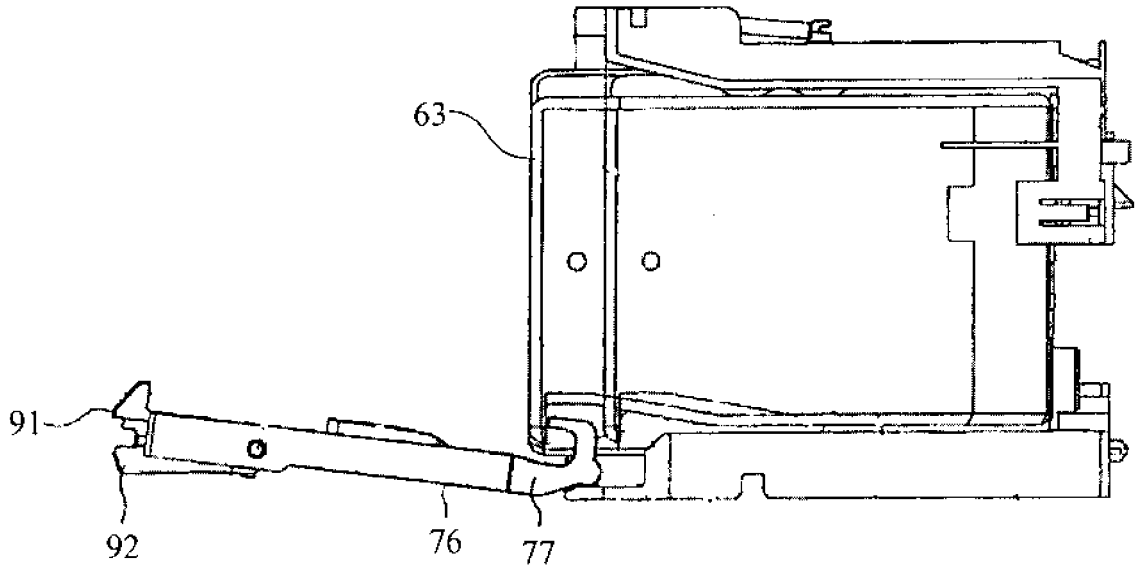
FIG.16 (Prior Art)
FIG. 16 is a perspective view of the prior art.

FIG. 15 shows a ninth embodiment of the present invention. The pushing mechanism 12 of this embodiment is changed from the flipping lever 124 into the sliding block 121, and has the first compressive elastic member 125. One end of the first compressive elastic member 125 is connected to the sliding block 121, and the other end is connected to the fixing hook 31 protruded from the casing 10. Similar to the first embodiment, the installation hole 102 for installing the sliding block 121 and the guiding chute 103 communicated with the installation hole 102 are opened on the casing 10. The difference between this embodiment and the second embodiment is that the first torsion spring 4 is replaced by the second compressive elastic member 8 disposed between the casing 10 and the main body 111. It should be noted that, the second compressive elastic member 8 should be disposed on the back end position of the main body, so as to ensure that the locking portion 115 applies a restraining force to the locked surface 211 of the ink cartridge, so as to lock the ink cartridge 63.

Among all the above embodiments, each part of the mechanism may be combined flexibly, which is not limited to the descriptions in the specification. As known from the above descriptions and accompanying drawings, when being unloaded or loaded, the ink cartridge is horizontally loaded or unloaded, and the problems of unsmooth loading or unloading or getting stuck during loading or unloading do not occur. In addition, the ink cartridge carrier device provides an inward and downward pressure for the ink cartridge, so as to ensure that the ink cartridge is well fixed. The carrier device has a self-lock function, such that the ink cartridge cannot be pulled out under an external force unless the locking unlocking mechanism is rotated. When the ink cartridge is unloaded, the pushing mechanism pushes a part of the ink cartridge out of the casing, and the user takes out the ink cartridge by holding the pushed-out part with hands. The ink cartridge has a guiding surface, and the guiding surface slidingly contacts with the locking portion, such that the ink cartridge can be smoothly loaded. Thus, it is convenient for loading, unloading, and replacing the ink cartridge.

What is claimed is:

1. An ink cartridge carrier device for carrying an ink cartridge, comprising:

a casing, having an opening and an inner chamber communicated with each other to carry the ink cartridge;

a locking/unlocking mechanism pivoted on the casing, the locking/unlocking mechanism releasably engaging the ink cartridge and applying a restraining force thereto for holding the ink cartridge within the inner chamber;

a pushing mechanism for unloading the ink cartridge, the pushing mechanism contacting the ink cartridge and applying a pushing force to push the ink cartridge out of the casing responsive to the locking/unlocking mechanism being rotatably displaced to release engagement thereof with the ink cartridge and thereby release the restraining force therefrom; and a first elastic member having two opposing ends respectively connected to the locking/unlocking mechanism and the pushing mechanism for providing both the restraining force and the pushing force.

2. The ink cartridge carrier device according to claim 1, wherein the locking/unlocking mechanism has a locking portion, the locking portion extending in the casing for engagement with the ink cartridge and thereby apply the restraining force to the ink cartridge within the inner chamber.

3. The ink cartridge carrier device according to claim 1, wherein the pushing mechanism includes a sliding block, a guiding chute is opened on the casing, and the sliding block slides along the guiding chute.

4. The ink cartridge carrier device according to claim 1, wherein the pushing mechanism includes a second elastic member disposed on the casing or in the chamber.

5. The ink cartridge carrier device according to claim 1, wherein the pushing mechanism includes a flipping lever connected to the locking/unlocking mechanism.

6. The ink cartridge carrier device according to claim 3, wherein the sliding block is connected to the first elastic member.

7. The ink cartridge carrier device according to claim 2, wherein the ink cartridge has a guiding surface, slidingly contacting with the locking portion, such that the ink cartridge is conveniently accommodated into the inner chamber.

8. The ink cartridge carrier device according to claim 5, wherein the ink cartridge has a flipped portion, actuated by the flipping lever, so as to flip a part of the ink cartridge out of the casing.

9. The ink cartridge carrier device according to claim 2, wherein the ink cartridge has a locked surface, and the locking portion contacts with the locked surface, so as to fix the ink cartridge within the inner chamber.

10. The ink cartridge carrier device according to claim 9, wherein the locked surface has a self-lock line; once the locking portion is moved to a position of the self-lock line, the locking/unlocking mechanism is self-locked, so that the ink cartridge carried in the inner chamber is not able to be taken out by an external force.

* * * * *